US011139153B2

(12) United States Patent
Hayashi

(10) Patent No.: US 11,139,153 B2
(45) Date of Patent: Oct. 5, 2021

(54) MCP ASSEMBLY AND CHARGED PARTICLE DETECTOR

(71) Applicant: HAMAMATSU PHOTONICS K.K., Hamamatsu (JP)

(72) Inventor: Masahiro Hayashi, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/252,473

(22) PCT Filed: Jun. 14, 2019

(86) PCT No.: PCT/JP2019/023758
§ 371 (c)(1),
(2) Date: Dec. 15, 2020

(87) PCT Pub. No.: WO2019/244805
PCT Pub. Date: Dec. 26, 2019

(65) Prior Publication Data

US 2021/0193445 A1 Jun. 24, 2021

(30) Foreign Application Priority Data

Jun. 22, 2018 (JP) ..... JP2018-118991

(51) Int. Cl.
*H01J 43/24* (2006.01)
*H01J 43/28* (2006.01)

(52) U.S. Cl.
CPC ..... *H01J 43/246* (2013.01); *H01J 43/28* (2013.01)

(58) Field of Classification Search
None
See application file for complete search history.

(56) References Cited

U.S. PATENT DOCUMENTS 4,568,853 A 2/1986 Boutot
7,564,043 B2 7/2009 Hayashi et al.
(Continued)

FOREIGN PATENT DOCUMENTS

JP S57-196466 A 12/1982
JP 2005-538346 A 12/2005
(Continued)

OTHER PUBLICATIONS

International Preliminary Report on Patentability dated Dec. 30, 2020 for PCT/JP2019/023758.

*Primary Examiner* — Ashok Patel
(74) *Attorney, Agent, or Firm* — Faegre Drinker Biddle & Reath LLP

(57) ABSTRACT

The MCP assembly of this embodiment is formed at least of a conductive upper support member, an MCP unit, an output electrode, a flexible sheet electrode, and a conductive lower support member as a structure for improving handleability of a flexible sheet electrode having a mesh area. The flexible sheet electrode includes the mesh area provided with plural openings. The flexible sheet electrode and the lower support member are physically and electrically connected to each other, and the flexible sheet electrode is sandwiched between the upper support member and the lower support member. As a result, even if the flexible sheet electrode becomes thin as an opening ratio of the mesh area increases, potential is set while the flexible sheet electrode is firmly held in the MCP assembly.

16 Claims, 8 Drawing Sheets

(56) References Cited

U.S. PATENT DOCUMENTS

| | | | | |
|---|---|---|---|---|
| 2005/0258356 | A1 | 11/2005 | Ecelberger et al. | |
| 2008/0290267 | A1 | 11/2008 | Hayashi et al. | |
| 2010/0019397 | A1* | 1/2010 | Youn | H01L 24/06 257/784 |
| 2017/0047213 | A1* | 2/2017 | Hayashi | H01J 49/025 |

FOREIGN PATENT DOCUMENTS

| | | | |
|---|---|---|---|
| JP | 2006-185828 | A | 7/2006 |
| JP | 2007-057432 | A | 3/2007 |
| JP | 2011-119279 | A | 6/2011 |
| JP | 2014-78388 | A | 5/2014 |
| JP | 2016-139606 | A | 8/2016 |
| JP | 2017-037782 | A | 2/2017 |
| WO | WO-2004/008481 | A1 | 1/2004 |

* cited by examiner

MCP ASSEMBLY AND CHARGED PARTICLE DETECTOR

TECHNICAL FIELD

The present invention relates to an MCP assembly including an MCP unit constituted by plural microchannel plates (hereinafter referred to as MCPs), and a charged particle detector including the same.

BACKGROUND ART

As a detector that enables highly sensitive detection of charged particles such as ions and electrons, for example, a charged particle detector provided with a multiplying means such as the MCP for obtaining a constant gain is known. Such charged particle detector is generally installed as a measuring instrument in a vacuum chamber of a mass spectrometer and the like.

FIG. 1A illustrates a schematic configuration of a residual gas analyzer (RGA) as an example of the mass spectrometer. As illustrated in FIG. 1A, a residual gas analyzer 1 is such that an ion source 10, a focusing lens 20, a mass spectrometric unit 30, and a measurement unit 100 are arranged in a vacuum chamber maintained at a constant vacuum degree.

In the residual gas analyzer 1, a residual gas introduced into the ion source 10 is ionized by collision with thermoelectrons emitted from a filament at high temperature. Ions generated in the ion source 10 in this manner are guided to the mass spectrometric unit 30 while being accelerated and focused when passing through the focusing lens 20 constituted by plural electrodes. The mass spectrometric unit 30 distributes ions having different masses by applying a DC voltage and an AC voltage to four cylindrical electrodes (quadrupole). That is, the mass spectrometric unit 30 may change voltages applied to the four cylindrical electrodes, thereby allowing selective passage of ions having mass-to-charge ratios according to values thereof. The measurement unit 100 detects, as a signal (ion current), the ions that pass through the mass spectrometric unit 30 out of the ions introduced to the mass spectrometric unit 30 as described above. This ion current is proportional to an amount of residual gas (partial pressure).

As the measurement unit 100, for example, a charged particle detector 100A provided with an MCP unit 200 for obtaining a constant gain as illustrated in FIG. 1B is applicable. The MCP unit 200 includes an input surface 200*a* and an output surface 200*b*, and includes two MCPs 210 and 220 arranged in a state stacked in a space between the input surface 200*a* and the output surface 200*b*. The charged particle detector 100A is provided with such MCP unit 200 for obtaining a desired gain and an anode electrode 240 for taking in electrons emitted from the output surface 200*b* of the MCP unit 200. To the input surface 200*a* and the output surface 200*b* of the MCP unit 200, voltages of different values (negative voltages) are applied from a voltage control circuit (bleeder circuit) so that potential of the output surface 200*b* is higher than that of the input surface 200*a*. In contrast, potential of the anode electrode 240 is set to ground potential (0 V), and the electrons from the MCP unit 200 taken into the anode electrode 240 are inputted to an amplifier 250 as an electric signal. Then, the electric signal amplified by the amplifier 250 (amplified signal) is detected from an output terminal OUT.

Note that Patent Documents 1 to 3 disclose, as a charged particle detector 100A, a detector (MCP detector) in which a mesh electrode is adopted as a part of electrodes constituting a secondary electron multiplying structure.

CITATION LIST

Patent Literature

Patent Document 1: Japanese Patent Application Laid-Open No. 2014-78388

Patent Document 2: Japanese Patent Application Laid-Open No. S57-196466

Patent Document 3: Japanese Patent Application Laid-Open No. 2017-37782

SUMMARY OF INVENTION

Technical Problem

As a result of examination of the conventional charged particle detector, the inventors found the following problems. That is, the detector disclosed in Patent Document 1 is provided with a limiting structure for confining reflected electrons emitted from an anode electrode in response to incidence of secondary electrons from an MCP unit in a space between an accelerating electrode having a mesh structure (mesh electrode) and the anode electrode. The detector disclosed in Patent Document 2 is provided with an inverted dynode arranged so as to sandwich an anode electrode having a mesh structure (mesh electrode) together with an MCP unit, and potential of the inverted dynode is set to be lower than potential of the anode electrode. In such secondary electron multiplying structure, secondary electrons that pass through the anode electrode out of the secondary electrons emitted from the MCP unit arrive at the inverted dynode. Then, the secondary electrons further multiplied in the inverted dynode move on to the anode electrode.

Note that a time-of-flight measurement mass spectrometer (TOF-MS) and the like performance of which is improved due to a long ion flight distance out of the mass spectrometers requires measurement in a high-vacuum state of about $10^{-4}$ Pa (about 10-$^{6}$ Torr). In contrast, for the purpose of simplifying a vacuum exhaust mechanism (reduction in manufacturing cost), shortening a mean free path of ions (small sizing of device) and the like, there also is an increasing demand for development of a charged particle detector capable of performing high-sensitive mass spectrometry in a low-vacuum state of about $10^{-1}$ Pa (about $10^{-3}$ Torr), and high-sensitivity (low-noise) ion detection of a gain of about $10^{5}$ in a low-vacuum environment of about $10^{-1}$ Pa (about $10^{-3}$ Torr) is especially desired.

In contrast, as the vacuum degree decreases, the number of residual gas molecules in a chamber increases, so that in mass spectrometry in the low-vacuum environment, an increase in dark noise due to ionization (electron ionization) of the unnecessary residual gas molecules poses a problem. Specifically, as illustrated in FIG. 1B, it is considered that this is caused by generation of the residual gas ions due to collision of electrons emitted from the MCP unit 200 and the residual gas molecules present between the electrodes. Note that it is known that, in this electron ionization, ionization efficiency becomes the highest due to the collision of the electrons of 70 to 100 eV (output electron energy of MCP is 80 to 100 eV), and most of residual gas ions generated by the electron ionization are positive ions (positively charged particles) ((element M)+($e^{-}$)->($M^{+}$)+2($e^{-}$)).

In electrode arrangement in FIG. 1B, the potential of the anode electrode 240 is set to be higher than the potential on an output side of the MCP unit 200, so that unnecessary positive ions ($M^+$) generated between the electrodes directly move on to the output surface 200*b* of the MCP unit 200 (path indicated by arrow A in FIG. 1B) or arrive at the input surface 200*a* of the MCP unit 200 after floating around the charged particle detector 100A (path indicated by arrow B in FIG. 1B). In this manner, when a phenomenon that the unnecessary positive ions generated between the electrodes in the charged particle detector 100A arrive at the MCP unit 200, that is, ion feedback occurs, the electrons derived from the residual gas are detected as dark noise, so that it becomes difficult to detect charged particles with high sensitivity in the low-vacuum environment.

Patent Document 3 suggests a charged particle detector having a structure for efficiently suppressing a feedback phenomenon (ion feedback) to an electron multiplying structure (MCP) side of the positively charged particles generated by the electron ionization in the low-vacuum environment described above and a method of controlling the same. Specifically, the detector disclosed in Patent Document 3 adopts a triode structure in which an electrode for trapping negatively charged particles (electrode corresponding to the anode electrode 240 in FIG. 1A) constituted by a mesh electrode and an electrode for trapping positively charged particles of the unnecessary positively charged particles are arranged in this order on the output side of the MCP unit.

As described above, in any of the detectors disclosed in Patent Documents 1 and 2 described above, the mesh electrode capable of serving as the accelerating electrode or the anode electrode preferably has a higher opening ratio in order to improve transmittance of the secondary electrons. Similarly, in the detector disclosed in Patent Document 3 described above also, the electrode for trapping negatively charged particles having the mesh structure preferably has a higher opening ratio in order to improve the transmittance of the unnecessary charged particles (positively charge particles).

However, since a thickness of the mesh electrode itself decreases as the opening ratio increases, such mesh electrode itself cannot obtain sufficient physical strength when the opening ratio is high.

In this case, it is highly possible that the mesh electrode itself is incorporated in a bent state at an assembling step of the charged particle detector.

The present invention is achieved to solve the above-described problems, and an object thereof is to provide an MCP assembly having a structure for improving handleability of a thin electrode including a mesh area and a charged particle detector including the same.

Solution to Problem

The MCP assembly according to this embodiment is an electronic component applicable to any of the detectors disclosed in Patent Documents 1 to 3 described above, and adopts a structure of grasping a flexible sheet electrode having a mesh structure by another electrode member. Specifically, the MCP assembly is at least provided with an upper support member, a lower support member, an MCP unit, an output electrode, and the flexible sheet electrode. The upper support member includes a first opening for charged particles to pass and is comprised of a conductive material. The lower support member includes a second opening and is comprised of the conductive material. The lower support member is arranged such that the first and second openings overlap along the predetermined axis. The MCP unit is arranged between the upper support member and the lower support member and is provided with an input surface and an output surface. The input surface includes an input effective area in which one opening ends of plural electron multiplication channels are arranged, and abuts the upper support member in a state in which the input effective area is exposed from the first opening of the upper support member. The output surface includes an output effective area in which the other opening ends of the plural electron multiplication channels are arranged. The output electrode is arranged between the MCP unit and the lower support member. The output electrode also includes a third opening for exposing the output effective area of the output surface, and abuts the output surface in a state in which the output effective area is exposed from the third opening. The flexible sheet electrode is arranged between the output electrode and the lower support member and includes an upper surface facing a second end face of the output electrode, a lower surface at least partially abutting a principal surface of the lower support member facing the upper support member, and a mesh area provided with plural openings each allowing the upper surface and the lower surface to communicate with each other.

The charged particle detector according to this embodiment adopting the MCP assembly having the above-described structure is provided with the MCP unit for realizing an electron multiplying function, and may apply predetermined potential while firmly holding the flexible sheet electrode by the upper support member and the lower support member. Therefore, it is possible to increase the opening ratio while decreasing a thickness of the mesh area of the flexible sheet electrode.

Note that each embodiment according to the present invention may be more sufficiently understood by the following detailed description and accompanying drawings. These examples are given for illustrative purposes only and should not be considered as limiting the invention.

A further application scope of the present invention becomes apparent from the following detailed description. However, although the detailed description and specific case indicate a preferred embodiment of the present invention, they are described for illustrative purposes only, and it is clear that various deformation and improvement within the scope of the present invention are obvious for those skilled in the art from the detailed description.

Advantageous Effects of Invention

According to this embodiment, by a structure in which the flexible sheet electrode is adopted as the mesh electrode and such flexible sheet electrode is grasped by the support member (electrode member) comprised of the conductive material, it becomes possible to improve handleability of the mesh electrode. Since the flexible sheet electrode is provided with a deformation suppressing portion extending from an outer edge of the mesh area serving as the mesh electrode, the flexible sheet electrode itself may be easily handled.

DESCRIPTION OF EMBODIMENTS

Figure 1A:
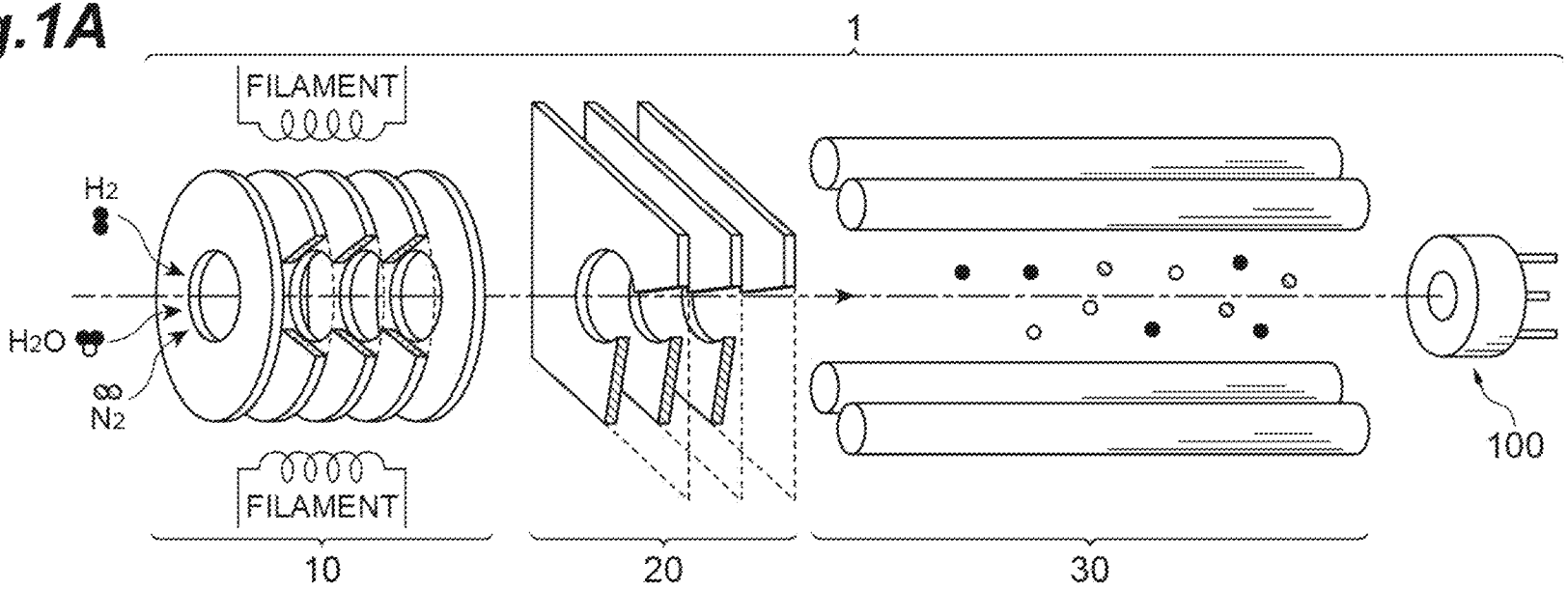
FIGS. 1A and 1B are views illustrating an example of a configuration of a residual gas analyzer as an example of a mass spectrometer and a structure of a general charged particle detector, respectively.
Figure 1B:
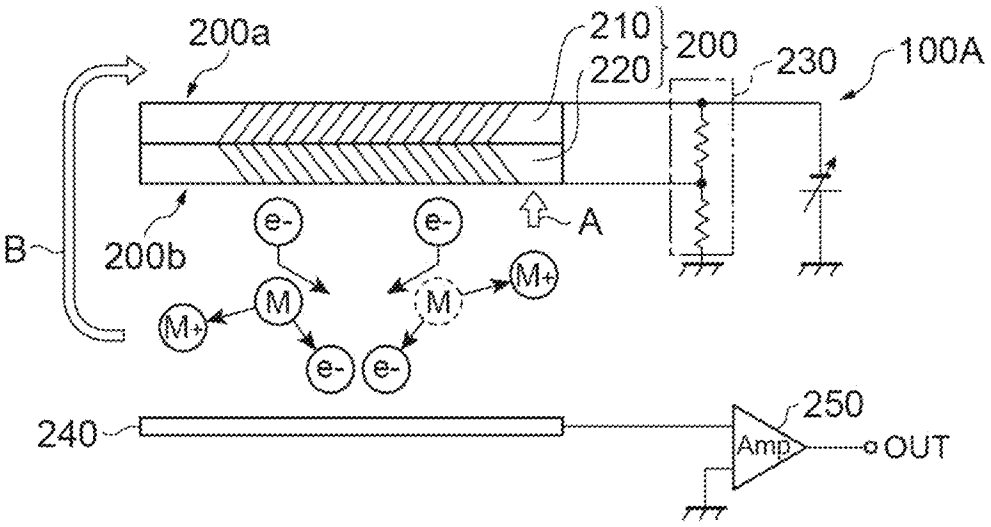

Description of Embodiment of Invention of Present Application

First, the contents of an embodiment of the invention of the present application are listed and described individually.

(1) An MCP assembly according to this embodiment is at least provided with an upper support member, a lower support member, an MCP unit, an output electrode, and a flexible sheet electrode as one aspect thereof. The upper support member includes a first opening for charged particles to pass and is comprised of a conductive material. The lower support member includes a second opening and is comprised of the conductive material. The lower support member is arranged such that the first and second openings overlap along the predetermined axis. The MCP unit is arranged between the upper support member and the lower support member and is provided with an input surface and an output surface. The input surface includes an input effective area in which one opening ends of plural electron multiplication channels are arranged, and abuts the upper support member in a state in which the input effective area is exposed from the first opening of the upper support member. The output surface includes an output effective area in which the other opening ends of the plural electron multiplication channels are arranged. The output electrode is arranged between the MCP unit and the lower support member. The output electrode also includes a third opening for exposing the output effective area of the output surface, and abuts the output surface in a state in which the output effective area is exposed from the third opening. The flexible sheet electrode is arranged between the output electrode and the lower support member and includes an upper surface facing the output electrode, a lower surface partially abutting a principal surface of the lower support member facing the upper support member, and a mesh area provided with plural openings each allowing the upper surface and the lower surface to communicate with each other. With this configuration, the upper surface of the flexible sheet electrode is held in a predetermined position in a state of being physically separated from the principal surface of the lower support member.

The upper support member is configured such that potential thereof is set to first potential, and may substantially serve as an MCP input side electrode for setting potential of the input surface of the MCP unit to the first potential (hereinafter, referred to as "MCP-In electrode"). The output electrode is configured such that potential thereof is set to second potential higher than the first potential, and may substantially serve as an MCP output side electrode (hereinafter, referred to as "MCP-Out electrode") for drawing out electrons (secondary electrons) multiplied by the MCP unit to the lower support member side. The lower support member is configured such that potential thereof is set to third potential higher than the second potential, and may substantially serve as a power supply electrode for setting potential of the flexible sheet electrode to predetermined potential. As an example of a secondary electron multiplying structure, in a triode structure in which an external electrode potential of which is set to fourth potential equal to or higher than the third potential (lower support member) is installed outside the MCP assembly, the external electrode the potential of which is set to the fourth potential serves as an electrode for trapping negatively charged particles (anode electrode), whereas the flexible sheet electrode serves as an accelerating electrode. As another example of the secondary electron multiplying structure, in an electrode structure in which an external electrode potential of which is set to fifth potential lower than the second potential (output electrode) is installed outside the MCP assembly, the flexible sheet electrode serves as the electrode for trapping negatively charged particles while serving as an output terminal of unnecessary charged particles (for example, positive ions) generated in a space between the output electrode and the lower support member. At that time, the external electrode serves as an electrode for trapping positively charged particles.

(2) As one aspect of this embodiment, an area of the flexible sheet electrode defined by a plane orthogonal to the predetermined axis is larger than an area of the second opening of the lower support member. As one aspect of this embodiment, a width (thickness) of the flexible sheet electrode along the predetermined axis is smaller than a width (thickness) of the lower support member. Furthermore, as one aspect of this embodiment, the flexible sheet electrode may include a deformation suppressing portion for suppressing deformation of the mesh area. In this case, the deformation suppressing portion corresponds to a flange of the mesh area provided so as to surround an outer edge of the mesh area, and has a shape continuously extending from the outer edge of the mesh area in a state of being located between the upper surface and the lower surface and abutting the lower support member.

Even in a configuration in which the flexible sheet electrode serves as the accelerating electrode as in the example of the secondary electron multiplying structure described above, in order to improve transmittance of the secondary electrons emitted from the MCP unit via the third opening of the output electrode, the flexible sheet electrode needs a mesh structure having a sufficient opening ratio. As in another example of the secondary electron multiplying structure described above, in a configuration in which the flexible sheet electrode serves as the electrode for trapping negatively charged particles (anode electrode) while serving as the output terminal of the unnecessary charged particles, in order to improve the transmittance of the unnecessary charged particles, the flexible sheet electrode needs the mesh area having a sufficient opening ratio. However, since a thickness of the mesh electrode itself decreases as the opening ratio increases, such mesh electrode itself cannot obtain sufficient physical strength. In this case, it is highly possible that the mesh electrode itself is incorporated in a bent state at an assembling step of the charged particle detector. Therefore, this embodiment adopts a structure in which at least a part of the flexible sheet electrode having such structure is grasped by another electrode member (upper support member and lower support member). Furthermore, as an application example thereof, in order to reinforce the mesh area in which a sufficient opening ratio is secured, the flexible sheet electrode may be provided with the deformation suppressing portion (flange) so as to surround the outer edge of the mesh area.

Herein, referring to a structural characteristic of the flexible sheet electrode constituted by the mesh area and the deformation suppressing portion surrounding the outer edge of the mesh area, the flexible sheet electrode includes a first surface facing the upper support member and a second surface facing the lower support member. The surface of the mesh area flush with the first surface and the surface of the deformation suppressing portion flush with the first surface are continuous. Similarly, the surface of the mesh area flush with the second surface and the surface of the deformation suppressing portion flush with the second surface are also continuous. That is, the width (thickness) of the mesh area and the width (thickness) of the deformation suppressing portion in a direction from the upper support member toward the lower support member (an electron advancing direction coinciding with the predetermined axis) are the same. However, since the deformation suppressing portion is not provided with an opening, physical strength of the deformation suppressing portion defined in the electron advancing direction (defined by a degree of bend occurring when a constant load is applied in the electron advancing direction) is inevitably higher than physical strength of the mesh area.

Note that, the "mesh area" in the flexible sheet electrode may be specified on one surface of the flexible sheet electrode (either the surface facing the upper support member or the surface facing the lower support member). Specifically, on one surface of the flexible sheet electrode, the "mesh area" is defined as an area sandwiched by openings on both ends out of plural openings located on a straight line passing through the center of gravity thereof. The "openings on both ends" are openings with one end adjacent to another opening and the other end being free on the above-described straight line. Therefore, an area from the openings on both ends to an edge of the flexible sheet electrode is the "deformation suppressing portion". The "opening ratio" in the mesh area is given by a ratio (percentage) of a "total area of the openings in an arbitrary area" to a "total area of the arbitrary area" in the arbitrary area in the mesh area.

(3) As one aspect of this embodiment, the mesh area and the deformation suppressing portion are continuous areas comprised of the same conductive material, and the continuous area has flexibility in the direction coinciding with the predetermined axis. Therefore, one surface of the mesh area flush with the upper surface of the flexible sheet electrode is continuous to one surface of the deformation suppressing portion flush with the upper surface of the flexible sheet electrode. Similarly, the other surface of the mesh area flush with the lower surface of the flexible sheet electrode is continuous to the other surface of the deformation suppressing portion flush with the lower surface of the flexible sheet electrode.

(4) As one aspect of this embodiment, the MCP assembly may be provide with a first insulating member arranged between the output electrode and the lower support member. In this case, the first insulating member at least serves as a spacer and includes a first end face abutting the output electrode and a second end face opposing the first end face. Note that the first insulating member may include a through hole defined by a continuous inner wall surface that surrounds an electron transfer space through which the electrons from the output surface of the MCP unit pass. The through hole has a maximum width larger than a maximum width of the output effective area so as to expose an entire output effective area. In this manner, by surrounding the electron transfer space (space where unnecessary charged particles are generated) between the output electrode (MCP-Out electrode) and the lower support member (power supply electrode) by the first insulating member, an area where the secondary electrons emitted from the MCP unit and the unnecessary charged particles may advance is limited to the mesh area on the flexible sheet electrode.

(5) As one aspect of this embodiment, the MCP assembly may further be provided with a second insulating member having a shape extending from the upper support member toward the lower support member in a state of being separated from the first insulating member by a predetermined distance for fixing relative positions of the upper and lower support members. In this case, the second insulating member includes a third end face fixed to the upper support member and a fourth end face fixed to the lower support member. As an example, both ends of the second insulating member are fixed to the upper and lower support members, respectively, by insulating screws.

(6) As one aspect of this embodiment, the relative positions of the upper support member and the lower support member may also be fixed by a third insulating member (insulating clip). Specifically, the third insulating member includes a first fixing unit, a second fixing unit, and a supporting unit provided with the first and second fixing units on both ends thereof. The first fixing unit is located on a side opposite to the MCP unit across the upper support member and abuts the upper support member so as to push the upper support member toward the lower support member. The second fixing unit is located on a side opposite to the MCP unit across the lower support member and abuts the lower support member so as to push the lower support member toward the upper support member. The supporting unit has a shape extending from the upper support member toward the lower support member, and is provided with the first and second fixing units on both ends thereof.

(7) The MCP assembly having the above-described structure is applicable to the charged particle detector according to this embodiment. That is, the charged particle detector is provided with, as one aspect thereof, the MCP assembly having the above-described structure, a housing that accommodates the MCP assembly, and a charged particle trapping structure for trapping the unnecessary charged particles emitted from the MCP assembly via the second opening of the lower support member.

(8) As one aspect of this embodiment, the charged particle trapping structure may include an external potential forming electrode installed in a position facing the lower support member. As one aspect of this embodiment, the external potential forming electrode preferably includes a second through hole that forms a part of the housing and allows the inside of the housing and the outside of the housing to communicate with each other. In this case, it becomes possible to effectively evacuate the charged particle detector.

Furthermore, as one aspect of this embodiment, the charged particle trapping structure may include a glass epoxy board on a surface of which at least an electric circuit is provided on which the housing is mounted. In this case, the charged particles that pass through the mesh area of the flexible sheet electrode are trapped in a negative potential portion on the glass epoxy board.

(9) Furthermore, the charged particle detector may also be provided with, as one aspect thereof, the MCP assembly having the above-described structure, the housing that accommodates the MCP assembly, and the secondary electron multiplying structure that attracts the secondary electrons multiplied by the MCP assembly and thereafter emitted from the MCP assembly via the second opening of the lower support member. As an example, the secondary electron multiplying structure may include an external electrode and a limiting structure. The external electrode is arranged on a side opposite to the MCP unit across the flexible sheet electrode and is configured such that potential is set to be equal to or higher than set potential of the flexible sheet electrode. The limiting structure includes an insulating ring including, for example, one end face abutting the mesh electrode and the other end face opposing the one end face in order to confine reflected electrons emitted from the external electrode in response to incidence of the secondary electrons from the MCP unit in the space between the flexible sheet electrode and the external electrode. A another example, the secondary electron multiplying structure may include a dynode (inverted dynode) arranged on the side opposite to the MCP unit across the flexible sheet electrode and is configured such that the potential is set to be lower than that of the flexible sheet electrode.

As described above, each aspect listed in this [Description of Embodiment of Invention of Present Application] is applicable to each of all the remaining aspects or all the combinations of the remaining aspects.

Embodiment of Invention of Present Application in Detail

A specific structure of the MCP assembly and the charged particle detector according to this embodiment is hereinafter described in detail with reference to the attached drawings. Note that the present invention is not limited to these illustrative examples but recited in claims, and it is intended that equivalents of claims and all the modifications within the scope are included. In the description of the drawings, the same reference sign is assigned to the same elements and the description thereof is not repeated.

Figure 2:
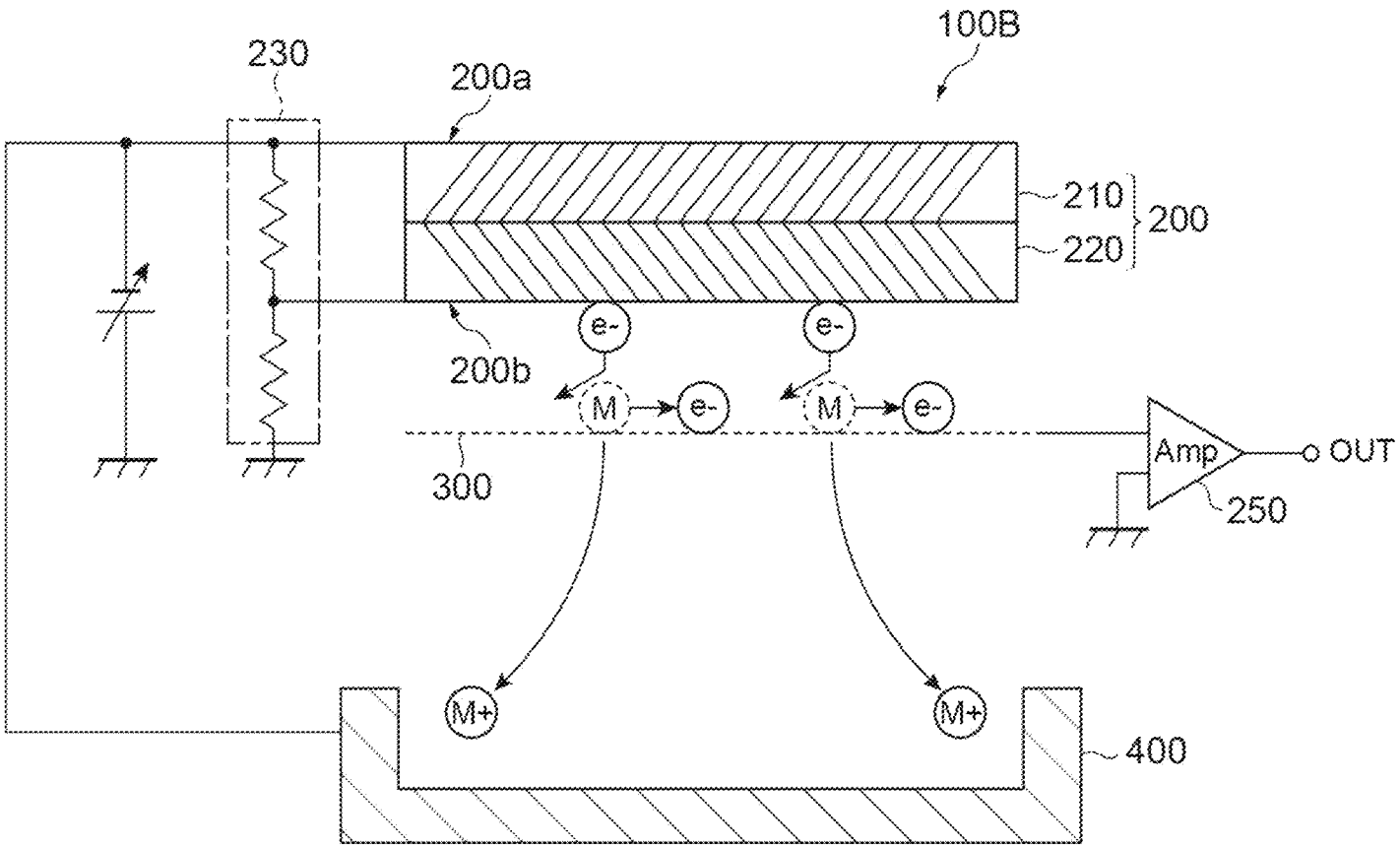
FIG. 2 is a view for explaining a schematic configuration of the charged particle detector according to this embodiment.
Figure 3A:
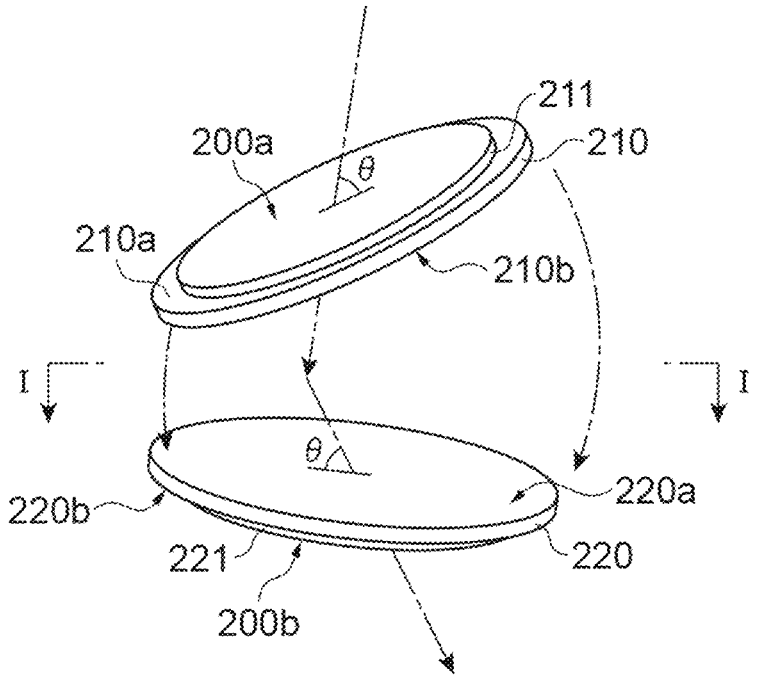
FIGS. 3A and 3B are views for explaining a schematic configuration of an MCP unit applicable to the charged particle detector according to this embodiment.
Figure 3B:
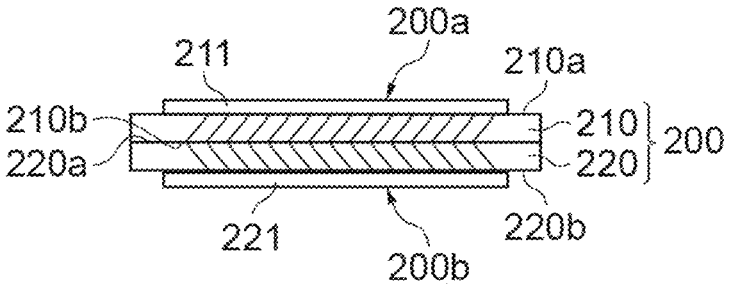

FIG. 2 is a view for explaining a schematic configuration of the charged particle detector according to this embodiment. FIGS. 3A and 3B are views for explaining a schematic configuration of the MCP unit applicable to the charged particle detector according to this embodiment.

A charged particle detector 100B according to this embodiment is applicable to a measurement unit 100 of a residual gas analyzer 1 illustrated in FIG. 1A. Specifically, the charged particle detector 100B has, as an example, a structure for selectively trapping negatively charged particles represented by electrons. As illustrated in FIG. 2, the charged particle detector 100B is provided with an MCP unit 200 including an input surface 200*a* and an output surface 200*b*, a mesh electrode (flexible sheet electrode having mesh area) 300 for reading electrons emitted from the output surface 200*b* of the MCP unit 200 as an electric signal, and a charged particle trapping structure (external potential forming electrode for trapping positively charged particles represented by positive ions and the like) 400 for trapping unnecessary positive ions ($M^+$) generated in a flight space of the electrons emitted from the output surface 200*b* of the MCP unit 200. To the input surface 200*a* and the output surface 200*b* of the MCP unit 200, voltages of different values (negative voltages) are applied from a bleeder circuit (voltage control circuit) 230 so that potential of the output surface 200*b* is higher than that of the input surface 200*a*. Potential of the mesh electrode 300 is set to ground potential (0 V), and the electrons from the MCP unit 200 taken into the mesh electrode 300 are inputted to an amplifier 250 as the electric signal. Then, the electric signal amplified by the amplifier 250 (amplified signal) is detected from an output terminal OUT. In contrast, potential of the charged particle trapping structure 400 is set to the same potential as that of the input surface 200*a* of the MCP unit 200 (potential lower than that of the output surface 200*b*), and unnecessary residual gas ions (mostly positive ions) generated by electron ionization in the flight space of the electrons emitted from the output surface 200*b* of the MCP unit 200 are trapped by the charged particle trapping structure 400. Therefore, in the charged particle detector 100B, generation of dark noise due to ion feedback is effectively suppressed.

Note that an example of a structure of the MCP unit 200 applied to the charged particle detector 100B is illustrated in FIGS. 3A and 3B. That is, FIG. 3A is a view illustrating an assembling step of the MCP unit 200, and FIG. 3B is a cross-sectional view of the MCP unit 200 taken along line I-I in FIG. 3A.

As illustrated in FIG. 3A, the MCP unit 200 is provided with an MCP 210 including an input surface 210*a* and an output surface 210*b*, and an MCP 220 including an input surface 220*a* and an output surface 220*b*. Plural electron multiplication channels formed on the MCP 210 (channels on an inner wall of which a secondary electron emission surface is formed) are inclined by a predetermined bias angle θ with respect to the input surface 210*a*. Similarly, plural electron multiplication channels formed on the MCP 220 (channels on an inner wall of which a secondary electron emission surface is formed) are also inclined by a predetermined bias angle θ with respect to the input surface 220*a*. Herein, the bias angle is an inclined angle of the channel provided so as to prevent incident charged particles from passing through the MCP without colliding with the inner wall of each channel.

The two MCPs 210 and 220 having the above-described structures are stacked by bonding the output surface 210*b* and the input surface 220*a* so that the bias angles thereof are not the same. Furthermore, an electrode 211 is formed on the input surface 210*a* of the MCP 210 by vapor deposition so as to cover an input effective area in which input opening ends of the electron multiplication channels are arranged, and an electrode 221 is formed on the output surface 220*b* of the MCP 220 by vapor deposition so as to cover an output effective area in which output opening ends of the electron multiplication channels are arranged. Therefore, in a state in which the two MCPs 210 and 220 are bonded together, an exposed surface of the electrode 211 serves as the input surface 200*a* of the MCP unit 200 and an exposed surface of the electrode 221 serves as the output surface 200*b* of the MCP unit 200. Herein, the electrode 211 does not cover the whole of the input surface 210*a* of the MCP 210, but is formed to expose the input surface 210*a* by 0.5 mm to 1.0 mm from an outer peripheral edge. The same applies to the electrode 221.

Figure 4:
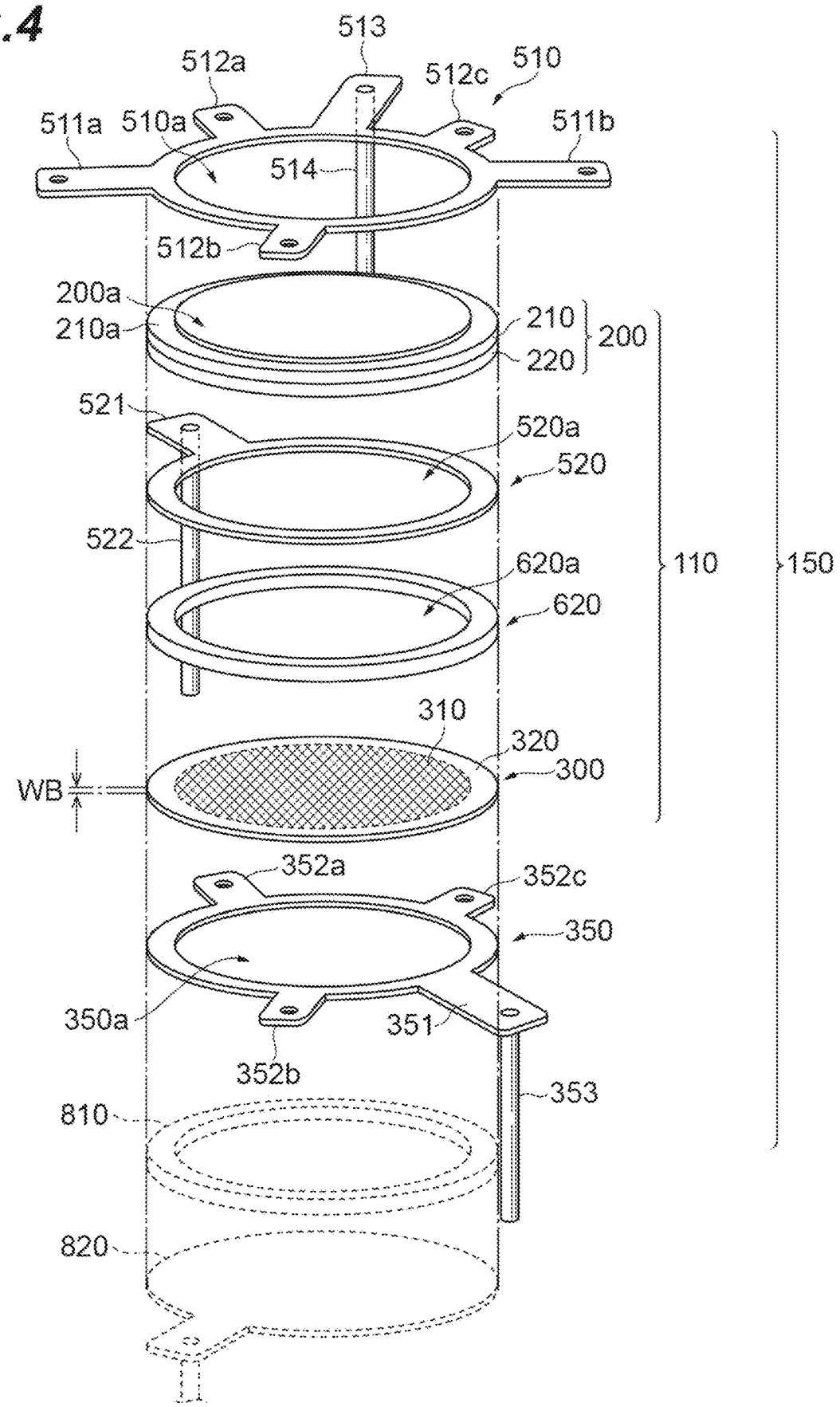
FIG. 4 is a view for explaining principal components of an MCP assembly applicable to the charged particle detector according to this embodiment.

FIG. 4 is a view for explaining principal components of the MCP assembly applicable to the charged particle detector according to this embodiment. Note that FIG. 4 illustrates the principal components for realizing an MCP assembly 150A (FIG. 5A) having a first grasping structure.

An MCP assembly 150 illustrated in FIG. 4 has a structure in which a stacked structure 110 is grasped by an MCP-In electrode (upper support member) 510 and a power supply electrode (lower support member) 350 as a pair of grasping members, and components of the MCP assembly 150 may be handled integrally. The stacked structure 110 sandwiched by the pair of grasping members (MCP-In electrode 510 and power supply electrode 350) is constituted by the MCP unit 200, an MCP-Out electrode 520, an insulating ring 620 (first insulating member), and the mesh electrode 300 arranged in this order from the MCP-In electrode 510 toward the power supply electrode 350.

The MCP-In electrode 510 that serves as the upper support member is the electrode for setting potential of the input surface 200*a* of the MCP unit 200 to predetermined potential and includes an opening 510*a*. Therefore, the MCP-In electrode 510 abuts the input surface 200*a* in a state in which the input effective area of the input surface 200*a* of the MCP unit 200 is exposed from the opening 510*a*. The potential of the MCP-In electrode 510 is set via a power supply pin 514. Therefore, the MCP-In electrode 510 includes a pin holding piece 513. Furthermore, the MCP-In electrode 510 is provided with assembly supporting pieces 511*a* and 511*b* for fixing an entire MCP assembly 150.

The MCP unit 200 has a structure as illustrated in FIG. 3A and FIG. 3B as an example, and is arranged between the MCP-In electrode 510 and the power supply electrode 350 in a mode in which the input surface 200*a* abuts the MCP-In electrode 510.

As an output electrode for drawing out electrons from the MCP unit 200, the MCP-Out electrode 520 includes a pin holding piece 521 that supports a power supply pin 522 and an opening 520*a* for exposing the output effective area included in the output surface 200*b* of the MCP unit 200. The MCP-Out electrode 520 abuts the output surface 200*b* of the MCP unit in a state in which the output effective area is exposed via the opening 520*a*.

The insulating ring 630 is arranged between the MCP-Out electrode 520 and the mesh electrode (flexible sheet electrode) 300. This insulating ring 630 is provided with a first end face that abuts the MCP-Out electrode, a second end face that abuts on the mesh electrode 300, and a through hole 620*a* that allows the first end face and the second end face to communicate with each other. That is, the insulating ring 620 includes the through hole 620*a* defined by a continuous inner wall surface that surrounds an electron transfer space through which the electrons from the output surface 200*b* of the MCP unit 200 pass. The through hole 620*b* has a maximum width larger than a maximum width of the output effective area so as to expose an entire output effective area included in the output surface 200*b*.

The mesh electrode 300 is the flexible sheet electrode having flexibility in an axial direction from the MCP-In electrode 510 toward the power supply electrode 350, and is arranged between the insulating ring 620 and the power supply electrode 350. The mesh electrode 300 includes the mesh area 310 including plural openings each allowing a surface located on the insulating ring 620 side and a surface located on the power supply electrode 350 side to communicate with each other, and the deformation suppressing portion 320 extending from the outer edge of the mesh area 310. Note that the mesh electrode 300 may be entirely formed only of the mesh area 310. On one surface of the mesh electrode 300, the mesh area 310 is defined as the area sandwiched by openings on both ends out of plural openings (electron multiplication channels) located on a straight line passing through the center of gravity of the surface (openings of which one end side is not adjacent to another opening on the straight line). The deformation suppressing portion 320 is the area from the openings on both ends to an edge of the mesh electrode 300.

As a structural characteristic of the mesh electrode 300, both surfaces of the mesh area 310 and the deformation suppressing portion 320 located on the insulating ring 620 side are continuous. Both surfaces of the mesh area 310 and the deformation suppressing portion 320 located on the power supply electrode 350 side are also continuous.

That is, the mesh area 310 and the deformation suppressing portion 320 are comprised of the same conductive material and form the continuous area. In addition, both the mesh area 310 and the deformation suppressing portion 320 have a predetermined thickness (width in the axial direction) WB. The power supply electrode 350 that serves as the upper support member includes a pin holding piece 351 that supports a power supply pin 353 and an opening 350*a* for exposing the mesh area 310, and abuts a part of the mesh electrode 300 (deformation suppressing portion 320). With this configuration, potential of the mesh electrode 300 is set to predetermined potential via the power supply electrode 350.

In the above-described mesh electrode 300, the opening ratio of the mesh area 310 may be arbitrarily set to 55% to 95%, and accordingly, the thickness WB is about 20 μm to 100 μm. Note that, as illustrated in FIG. 4, in a structure in which the deformation suppressing portion 320 having physical strength higher than that of the mesh area 310 is provided around the mesh area 310, the mesh electrode 300 as a single body may be easily handled as compared with the mesh electrode entirely constituted by the mesh area. Especially, in the example in FIG. 4, it is possible to adopt a structure in which the mesh electrode 300 as a single body is sandwiched by the insulating ring 620 and the power supply electrode 350, both of which are thicker than the deformation suppressing portion, with the deformation suppressing portion 320, which enables accurate and stable installation of the mesh electrode 300.

The MCP assembly 150 illustrated in FIG. 4 may be combined with various electrode members. For example, the MCP assembly 150 may be combined with an external electrode 820 via an insulating ring 810 having a structure similar to that of the insulating ring 620 described above. The external electrode 820 includes an external electrode potential of which is set to be equal to or higher than the potential of the mesh electrode 300, an external electrode potential of which is set to be higher than the potential of the MCP-Out electrode 520 and lower than the potential of the mesh electrode 300, an external electrode potential of which is set to be lower than the potential of the MCP-Out electrode 520 and the like. In a first secondary electron multiplying structure in which the external electrode the potential of which is set to be equal to or higher than the potential of the mesh electrode 300 and the MCP assembly 150 are combined, a triode structure is constituted by the MCP-Out electrode 520, the external electrode serving as an anode electrode, and the mesh electrode 300 serving as an accelerating electrode. In a second secondary electron multiplying structure in which the external electrode 820 the potential of which is set to be higher than the potential of the MCP-Out electrode 520 and lower than the potential of the mesh electrode 300 and the MCP assembly 150 are combined, the mesh electrode 300 serves as the anode electrode, whereas the external electrode 820 may serve as an inverted dynode by a secondary electron emission surface formed on its surface.

Furthermore, in a third secondary electron multiplying structure in which the external electrode 820 the potential of which is set to be lower than the potential of the MCP-Out electrode 520 and the MCP assembly 150 are combined, as in the example illustrated in FIG. 2, the mesh electrode serve as the anode electrode (electrode for trapping negatively charged particles), whereas the external electrode may serve as an electrode for trapping positively charged particles.

Figure 5A:
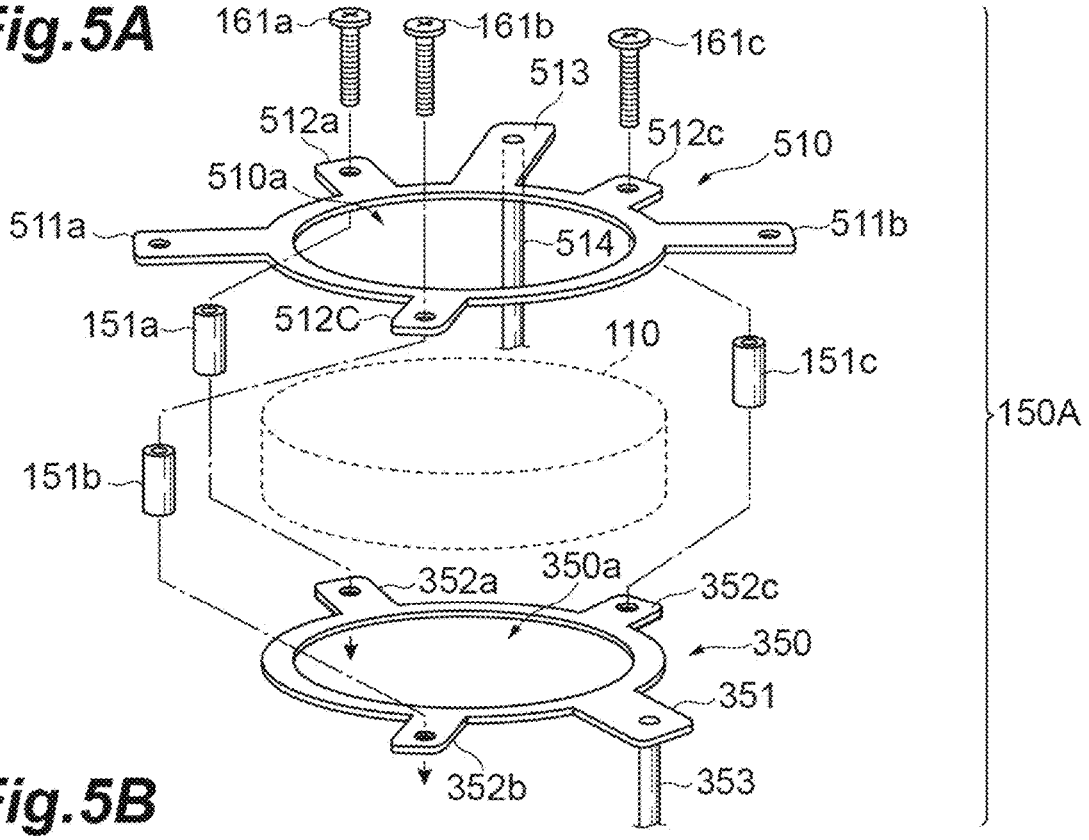
FIGS. 5A and 5B are views for explaining various grasping structures of the MCP assembly illustrated in FIG. 4.

Note that FIG. 4 illustrates a configuration for realizing the MCP assembly 150A having the first grasping structure illustrated in FIG. 5A. That is, the MCP-In electrode 510 is provided with fixing pieces 512*a*, 512*b*, and 512*c* for fixing a relative position with respect to the power supply electrode 350. In contrast, the power supply electrode 350 is provided with fixing pieces 352*a*, 352*b*, and 352*c* for fixing a relative position with respect to the MCP-In electrode 510. However, in order to realize an MCP assembly 150B having a grasping structure illustrated in FIG. 5B, the above-described fixing pieces 512*a* to 512*c* and 352*a* to 352*c* are not necessary.

FIG. 5A is a view for explaining an assembling step of the MCP assembly 150A having the first grasping structure. That is, the first grasping structure illustrated in FIG. 5A fixes the relative positions of the MCP-In electrode (upper support member) 510 and the power supply electrode (lower support member) 350 that grasp the stacked structure 110 by utilizing insulating spacers 151*a* to 151*c*. Note that each of the insulating spacers 151*a* to 151*c* is provided with a through hole extending in a longitudinal direction. The stacked structure 110 includes the MCP unit 200, the MCP-Out electrode 520, the insulating ring 620, and the mesh electrode 300 as described above.

One end faces of the insulating spacers 151*a* to 151*c* abut the fixing pieces 512*a* to 512*c* provided on the MCP-In electrode 510, respectively. The other end faces of the insulating spacers 151*a* to 151*c* abut the fixing pieces 352*a* to 352*c* provided on the power supply electrode 350, respectively. In this state, an insulating screw 161*a* is attached so as to pass through a screw hole of the fixing piece 512*a*, the through hole of the insulating spacer 151*a*, and a screw hole of the fixing piece 352*a*. An insulating screw 161*b* is attached so as to pass through a screw hole of the fixing piece 512*b*, the through hole of the insulating spacer 151*b*, and a screw hole of the fixing piece 352*b*. An insulating screw 161*c* is attached so as to pass through a screw hole of the fixing piece 512*c*, the through hole of the insulating spacer 151*c*, and a screw hole of the fixing piece 352*c*.

Figure 5B:
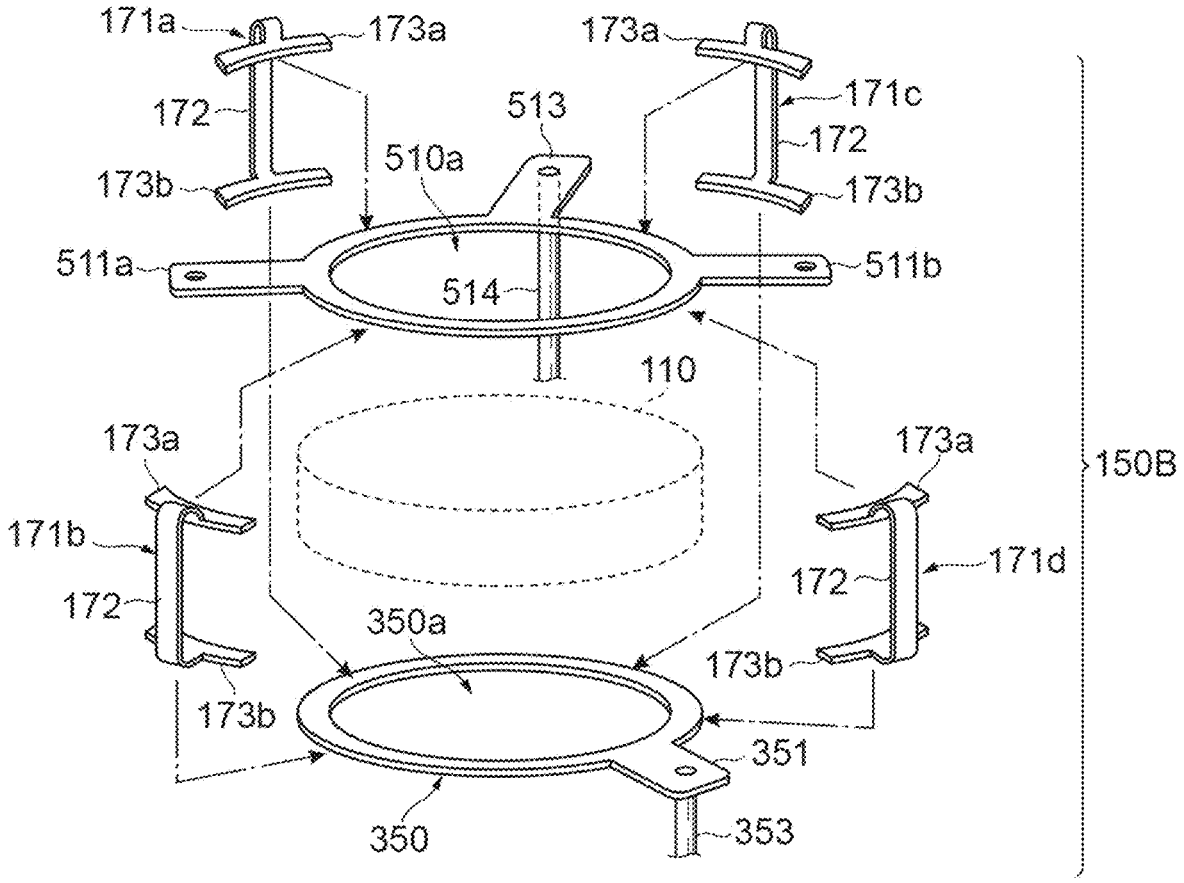

In contrast, FIG. 5B is a view for explaining an assembling step of the MCP assembly 150B having a second grasping structure. That is, the second grasping structure illustrated in FIG. 5B fixes the relative positions of the MCP-In electrode (upper support member) 510 and the power supply electrode (lower support member) 350 that grasp the stacked structure 110 by utilizing insulating clips 171*a* to 171*d*. Note that, in the MCP assembly 150B having the second grasping structure, the MCP-In electrode (upper support member) 510 is not provided with the fixing pieces 512*a* to 512*c* illustrated in FIGS. 4 and 5A. Similarly, the power supply electrode (lower support member) 350 is not provided with the fixing pieces 352*a* to 352*c* illustrated in FIGS. 4 and 5A.

As illustrated in FIG. 5B, each of the insulating clips 171*a* to 171*d* includes a first fixing unit 173*a*, a second fixing unit 173*b*, and a supporting unit 172 provided with the first and second fixing units 173*a* and 173*b* on both ends thereof. In each of the insulating clips 171*a* to 171*d*, the first fixing unit 173*a* is located on a side opposite to the stacked structure 110 across the MCP-In electrode 510, and abuts the MCP-In electrode 510 so as to push the MCP-In electrode 510 toward the power supply electrode 350. In contrast, the second fixing unit 173*b* is located on a side opposite to the stacked structure 110 across the power supply electrode 350, and abuts the power supply electrode 350 so as to push the power supply electrode 350 toward the MCP-In electrode 510.

In this manner, the second grasping structure illustrated in FIG. 5B may also fix the relative positions of the MCP-In electrode (upper support member) 510 and the power supply electrode (lower support member) 350 that grasp the stacked structure 110.

Figure 6:
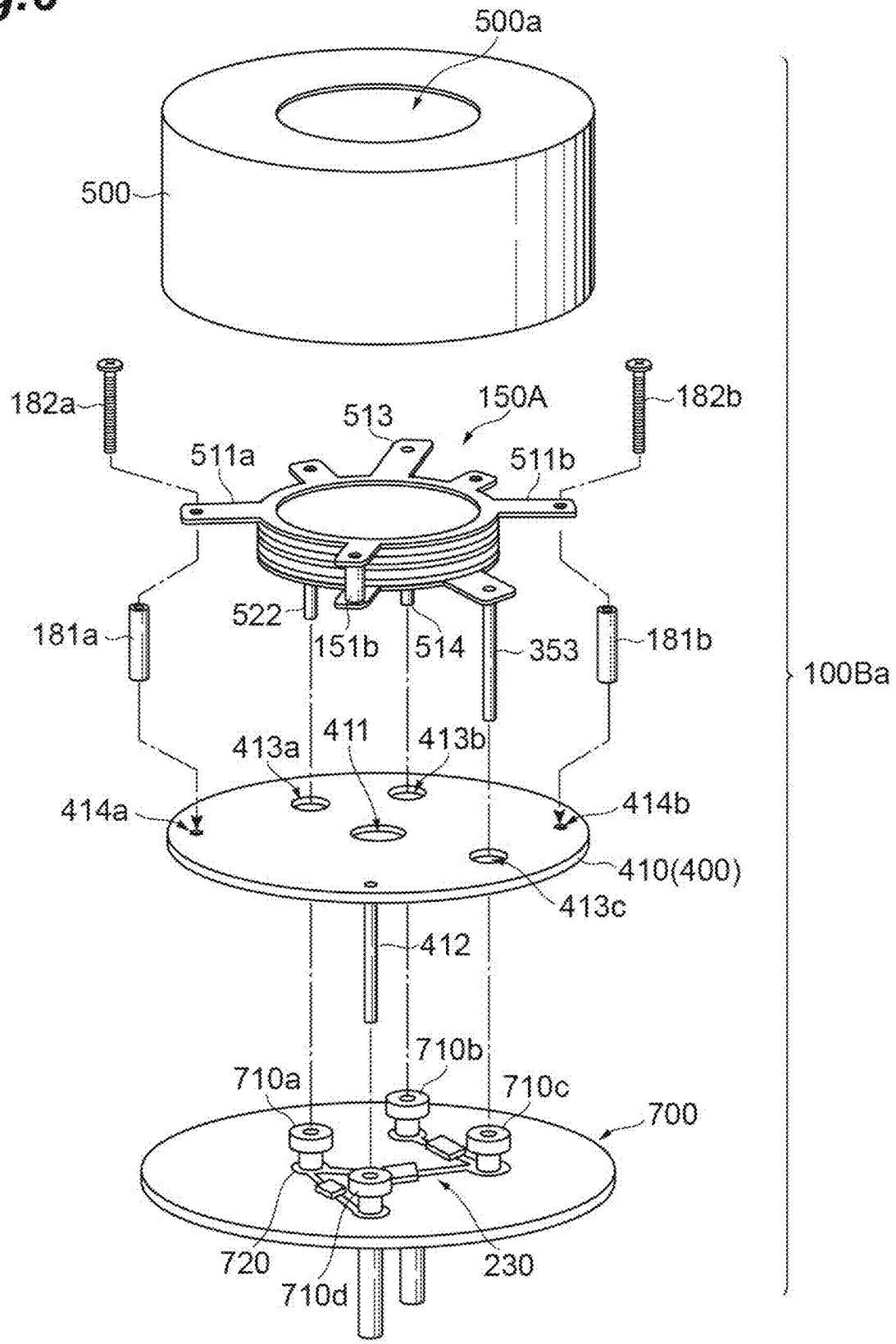
FIG. 6 is a view for explaining an assembling step of the charged particle detector according to this embodiment to which the MCP assembly of a first grasping structure illustrated in FIG. 5A is applied.
Figure 7A:
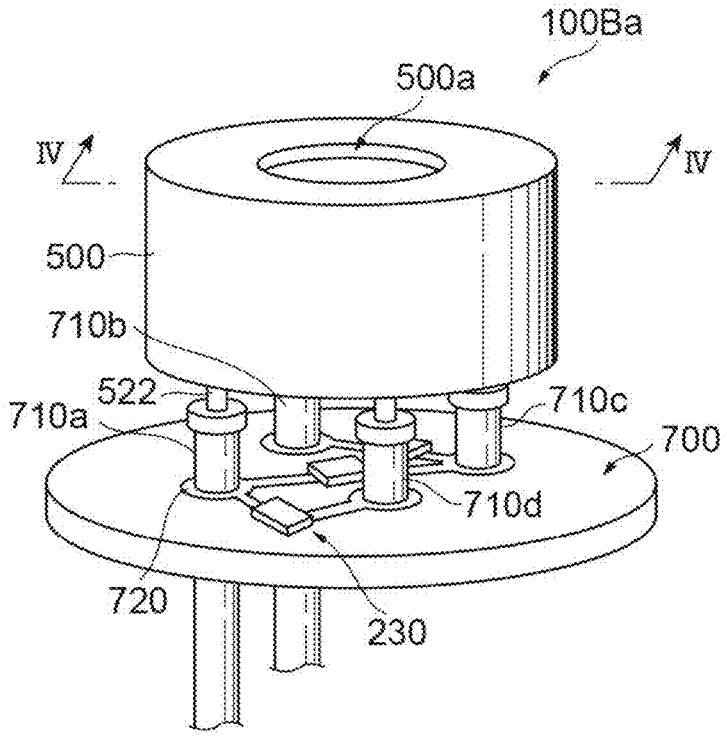
FIGS. 7A and 7B are a perspective view illustrating the charged particle detector obtained through the assembling step illustrated in FIG. 6 and a cross-sectional view illustrating an inner structure of the charged particle detector, respectively.
Figure 7B:
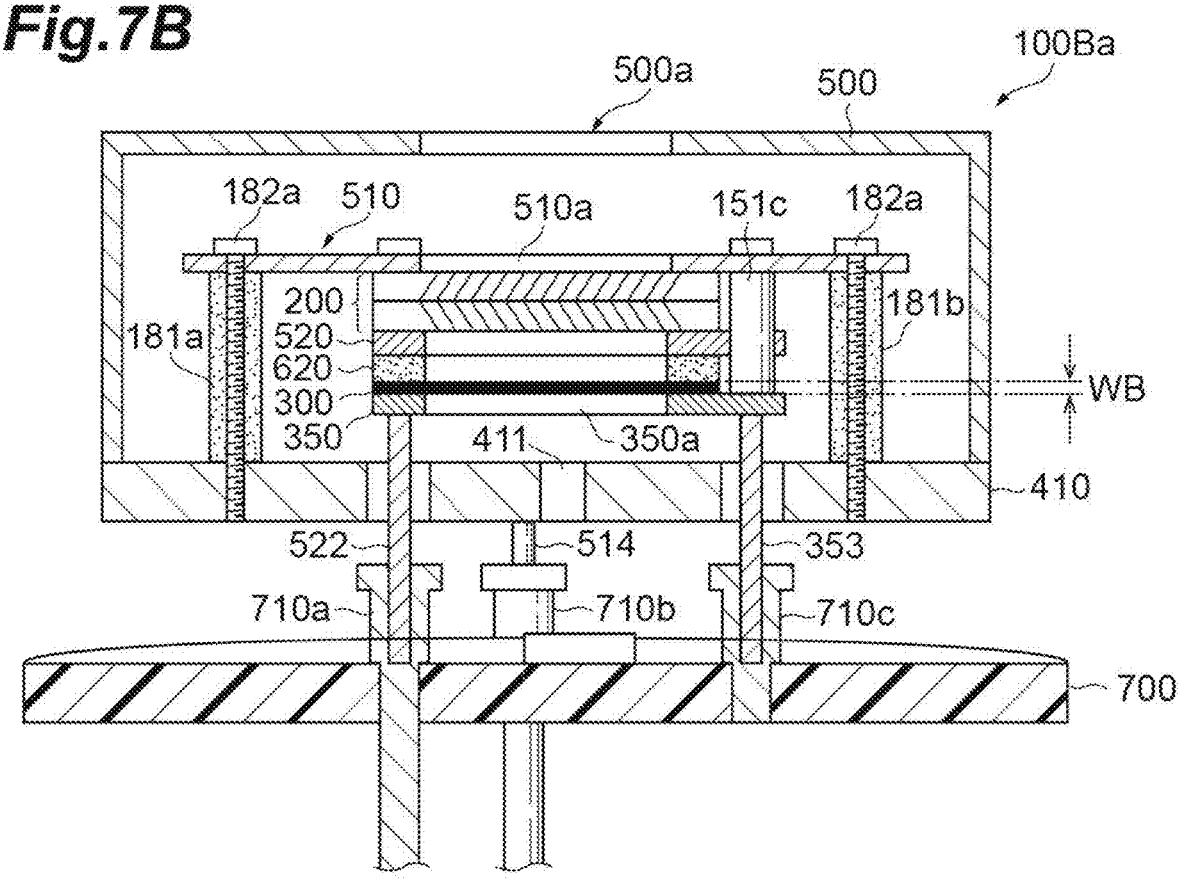
Figure 8:
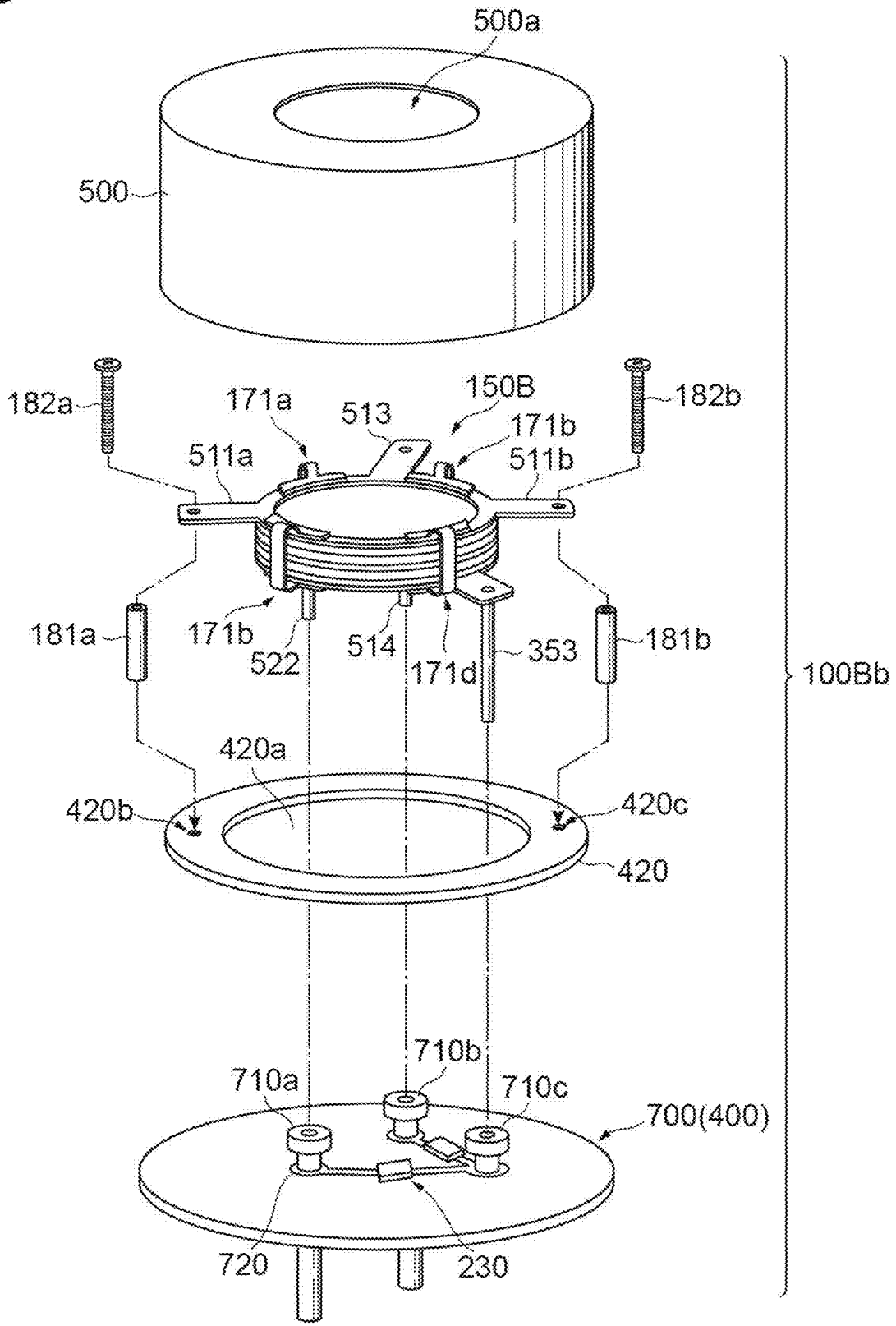
FIG. 8 is a view for explaining an assembling step of the charged particle detector according to this embodiment to which the MCP assembly of a second grasping structure illustrated in FIG. 5B is applied.

Next, a structure of the charged particle detector according to this embodiment is described with reference to FIGS. 6, 7A, 7B, and 8. Note that all of examples illustrated in FIGS. 6, 7A, 7B, and 8 illustrate the structure of the detector having the secondary electron multiplying structure illustrated in FIG. 2. FIG. 6 is a view for explaining an assembling step of a charged particle detector 100Ba to which the MCP assembly 150A having the first grasping structure illustrated in FIG. 5A is applied. FIG. 7A is a perspective view illustrating the charged particle detector 100Ba obtained through the assembling step illustrated in FIG. 6, and FIG. 7B is a cross-sectional view illustrating an inner structure of the charged particle detector 100Ba taken along line IV-IV in FIG. 7A. FIG. 8 is a view for explaining an assembling step of a charged particle detector 100Bb to which the MCP assembly 150B having the second grasping structure illustrated in FIG. 5B is applied.

At the assembling step of the charged particle detector 100Ba illustrated in FIG. 6, the MCP assembly 150A illustrated in FIG. 5A is installed on a bleeder circuit board 700 in a state of being accommodated in a housing. The housing that accommodates the MCP assembly 150A includes a housing body 500 that covers an entire MCP assembly 150A, and an external potential forming electrode 410 that serves as the charged particle trapping structure 400. The MCP assembly 150A is installed in a space constituted by the housing body 500 and the external potential forming electrode 410.

The housing body 500 is provided with an opening 500*a* for the charged particles to be measured to pass, and the input effective area included in the input surface 200*a* of the MCP unit 200 is exposed via the opening 500*a* and an opening 510*a* of the MCP-In electrode 510. In contrast, the external potential forming electrode 410 is provided, at its center, with a through hole 411 for enabling efficient evacuation of the housing. A hole 413*b* for the power supply pin 514 supported by the pin holding piece 513 of the MCP-In electrode 510 to pass through, a hole 413*a* for the power supply pin 522 supported by the pin holding piece 521 of the MCP-Out electrode 520 to pass through, and a hole 413*c* for the power supply pin 353 supported by the pin holding piece 351 of the power supply electrode 350 to pass through are provided. The external potential forming electrode 410 is provided with screw holes 414*a* and 414*b* for fixing the MCP assembly 150A, and a power supply pin 412 for setting potential of the external potential forming electrode 410 to desired potential is attached thereto.

Insulating spacers 181*a* and 181*b* are provided with through holes for insulating screws 182*a* and 182*b* to pass through, respectively, in a longitudinal direction. One end faces of the insulating spacers 181*a* and 181*b* abut assembly supporting pieces 511*a* and 511*b* provided on the MCP-In electrode 510, respectively, and the other end faces of the insulating spacers 181*a* and 181*b* abut sites of the external potential forming electrode 410 including the screw holes 414*a* and 414*b*, respectively. In this state, the insulating screw 182*a* is attached so as to pass through a screw hole of the assembly supporting piece 511*a*, the through hole of the insulating spacer 181*a*, and the screw hole 414*a* of the external potential forming electrode 410. In contrast, the insulating screw 182*b* is attached so as to pass through a screw hole of the assembly supporting piece 511*b*, the through hole of the insulating spacer 181*b*, and the screw hole 414*b* of the external potential forming electrode 410.

The bleeder circuit board 700 being a glass epoxy board having a disk shape serves as a supporting unit of the detector housing configured as described above and equipped with a bleeder circuit (voltage divider circuit) 230 for supplying a desired voltage to each electrode. Specifically, the bleeder circuit board 700 holds a metal socket 710*a* into which the power supply pin 522 of the MCP-Out electrode 520 is inserted, a metal socket 710*b* into which the power supply pin 514 of the MCP-In electrode 510 is inserted, a metal socket 710*c* into which the power supply pin 353 of the power supply electrode 350 electrically connected to the mesh electrode 300 is inserted, and a metal socket 710*d* into which the power supply pin 412 of the external potential forming electrode 410 (charged particle trapping structure 400) is inserted. The metal sockets 710*a* to 710*d* are electrically connected to the bleeder circuit 230 by printed wiring 720 formed on a surface of the bleeder circuit board 700. Note that, as long as a structure is such that the power supply pins 514, 522, 353, and 412 of the respective electrodes and the bleeder circuit 230 are electrically connected via the printed wiring 720, the sockets 710*a* to 710*d* may be comprised of a material other than metal.

The external potential forming electrode 410 is the electrode for trapping positively charged particles (external electrode) for trapping unnecessary residual gas ions ($M^+$) generated by electron ionization in the flight space of the secondary electrons emitted from the MCP unit 200. In an electrode space in which the triode structure is formed at least of the MCP-Out electrode 520, the mesh electrode 300, and the external potential forming electrode 410, potential of the external potential forming electrode 410 is set to be the lowest potential, so that the unnecessary positively charged particles generated in this electrode space inevitably move on to the external potential forming electrode 410. Therefore, due to presence of the external potential forming electrode 410, occurrence of a phenomenon that the generated residual gas ions move toward the MCP unit 200 side, that is, ion feedback may be effectively suppressed. Specifically, the external potential forming electrode 410 as the external electrode is provided with the power supply pin 412 to which a predetermined voltage is applied so that the potential is set to be lower than the potential of the MCP-Out electrode 520. Furthermore, the external potential forming electrode 410 is provided with holes 413*a* to 413*c* for the power supply pin 522 of the MCP-Out electrode 520, the power supply pin 514 of the MCP-In electrode 510, and the power supply pin 353 of the power supply electrode 350 electrically connected to the mesh electrode 300 to pass through without contact.

A configuration in which the MCP-In electrode 510 is set to be equal to the potential of the external potential forming electrode 410 may be adopted. For example, in a configuration of being electrically connected to a flange that defines the opening 500*a* of the housing body 500, by applying a predetermined voltage to the external potential forming electrode 410 via the power supply pin 412, the MCP-In electrode 510 and the external potential forming electrode 410 are set to have the same potential. Note that the set potential of the external potential forming electrode 410 may be set higher or lower than the potential of the MCP-In electrode 510 as long as this is lower than the potential of the MCP-Out electrode 520.

Next, the assembling step of the charged particle detector 100Bb to which the MCP assembly 150B having the second grasping structure illustrated in FIG. 5B is applied is described with reference to FIG. 8.

Note that the example illustrated in FIG. 8 is also an example of realizing the secondary electron multiplying structure in FIG. 2.

At the assembling step of the charged particle detector 100Bb illustrated in FIG. 8, the MCP assembly 150B illustrated in FIG. 5B is installed on the bleeder circuit board 700 in a state of being accommodated in a housing. The housing that accommodates the MCP assembly 150B includes a housing body 500 that covers an entire MCP assembly 150B and a housing bottom 420 for supporting the MCP assembly 150B. The MCP assembly 150B is installed in a space constituted by the housing body 500 and the housing bottom 420.

The housing body 500 is provided with an opening 500*a* for the charged particles to be measured to pass, and the input effective area included in the input surface 200*a* of the MCP unit 200 is exposed via the opening 500*a* and an opening 510*a* of the MCP-In electrode 510. In contrast, the housing bottom 420 is provided with, at the center thereof, an opening 420*a* for exposing the mesh area 310 of the mesh electrode 300 and for the power supply pin 514 of the MCP-In electrode 510, the power supply pin 522 of the MCP-Out electrode 520, and the power supply pin 353 of the power supply electrode 350 to pass through without contact. Furthermore, the housing bottom 420 is provided with screw holes 420*b* and 420*c* for holding the MCP assembly 150B in the housing.

Insulating spacers 181*a* and 181*b* are provided with through holes for insulating screws 182*a* and 182*b* to pass through, respectively, in a longitudinal direction. One end faces of the insulating spacers 181*a* and 181*b* abut assembly supporting pieces 511*a* and 511*b* provided on the MCP-In electrode 510, respectively, and the other end faces of the insulating spacers 181*a* and 181*b* abut sites of the housing bottom 420 including screw holes 414*a* and 414*b*, respectively. In this state, the insulating screw 182*a* is attached so as to pass through a screw hole of the assembly supporting piece 511*a*, the through hole of the insulating spacer 181*a*, and the screw hole 420*b* of the housing bottom 420. In contrast, the insulating screw 182*b* is attached so as to pass through a screw hole of the assembly supporting piece 511*b*, the through hole of the insulating spacer 181*b*, and the screw hole 420*c* of the housing bottom 420.

The bleeder circuit board 700 being a glass epoxy board having a disk shape serves as a supporting unit of the detector housing configured as described above and equipped with a bleeder circuit (voltage divider circuit) 230 for supplying a desired voltage to each electrode. Specifically, the bleeder circuit board 700 holds the metal socket 710*a* into which the power supply pin 522 of the MCP-Out electrode 520 is inserted, the metal socket 710*b* into which the power supply pin 514 of the MCP-In electrode 510 is inserted, and the metal socket 710*c* into which the power supply pin 353 of the power supply electrode 350 electrically connected to the mesh electrode 300 is inserted. The metal sockets 710*a* to 710*c* are electrically connected to the bleeder circuit 230 by printed wiring 720 formed on the surface of the bleeder circuit board 700. Note that, as long as a structure is such that the power supply pins 514, 522, and 353 of the respective electrodes and the bleeder circuit 230 are electrically connected via the printed wiring 720, the sockets 710*a* to 710*c* may be comprised of a material other than metal.

Note that in a configuration of the charged particle detector 100Bb illustrated in FIG. 8, the charged particle trapping structure includes the bleeder circuit board itself. In the bleeder circuit board 700 being a gas epoxy board on a surface of which an electric circuit is formed, since there are plural negative potential sites, a function equivalent to that of the external potential forming electrode 410 illustrated in FIG. 6 may be substantially realized as the charged particle trapping structure 400. Alternatively, as the charged particle trapping structure 400, an electrode pad corresponding to the external potential forming electrode 410 in FIG. 6 may be provided on the bleeder circuit board.

As described above, in this embodiment, in an electrode space in which the triode structure is constituted by at least the MCP-Out electrode 520, the mesh electrode 300, and the external potential forming electrode 410 as the charged particle trapping structure 400, as described above, the mesh electrode 300 being the electrode for trapping negatively charged particles is set to have the highest potential, and the external potential forming electrode 410 being the electrode for trapping positively charged particles is set to have the lowest potential. In such electrode space, the negatively charged particles such as electrons mainly emitted from the MCP unit 200 move on to the electrode set to have the highest potential, whereas the positively charged particles such as the unnecessary residual gas ions generated by electron ionization between the electrodes move on to the electrode set to have the lowest potential. Therefore, according to this embodiment, it becomes possible to separate electrons extracted as a signal and unnecessary residual gas ions (unnecessary charged particles), and selectively trap the unnecessary residual gas ions (positive ions) that cause ion feedback.

From the above description of the present invention, it is apparent that the present invention may be modified in various ways. For example, as a specific variation of the charged particle detector according to this embodiment, for example, a secondary electron multiplying structure constituted by the MCP assembly 150 illustrated in FIG. 4 and the external electrode 820 combined with the MCP assembly 150 may be provided. The potential of the external electrode 820 is set be equal to or higher than the potential of the mesh electrode 300. In such secondary electron multiplying structure, the mesh electrode 300 serves as the accelerating electrode, whereas the external electrode 820 serves as the anode electrode, so that in the secondary electron multiplying structure, the triode structure is constituted by the MCP-Out electrode 520, the mesh electrode 300, and the external electrode 820. In such triode structure, a limiting structure is preferably provided for confining reflected electrons emitted from the external electrode 820 serving as the anode electrode in response to incidence of the secondary electrons from the MCP assembly 150 in a space between the mesh electrode 300 serving as the accelerating electrode and the external electrode 820. Note that in the example in FIG. 4, the limiting structure includes the insulating ring 810 having a structure similar to that of the above-described insulating ring 620 (a continuous inner wall surface defines a through hole that surrounds a passage area of the secondary electrons).

As another variation of the charged particle detector according to this embodiment, the external electrode 820 in FIG. 4 may be used as an inverted dynode. In order to serve as the inverted dynode, a secondary electron emission surface is formed on the surface of the external electrode 820 as in each channel of the MCP unit 200, and the potential of the external electrode 820 is set to be higher than that of the MCP-Out electrode 520 and lower than that of the mesh electrode 300. Therefore, in this other variation, the mesh electrode 300 serves as the anode electrode, and the secondary electrons that pass through the mesh area 310 of the mesh electrode 300 are multiplied by the inverted dynode (external electrode 820) and thereafter emitted again from the inverted dynode toward the mesh electrode 300. Even in such a configuration, the insulating ring 810 may be provided between the mesh electrode 300 and the external electrode 820 as the limiting structure for limiting the movement of the secondary electrons into the space between the mesh electrode (anode electrode) 300 and the external electrode (inverted dynode) 820.

No deformation can be admitted to depart from the spirit and scope of the present invention, and all modifications obvious to a person skilled in the art are included in following claims.

REFERENCE SIGNS LIST

1 . . . Residual gas analyzer (mass spectrometer); 100B, 100Ba, 100Bb . . . Charged particle detector; 150, 150A, 150B . . . MCP assembly; 200 . . . MCP unit; 230 . . . Bleeder circuit (voltage control circuit); 300 . . . Mesh electrode (flexible sheet electrode); 310 . . . Mesh area; 320 . . . Deformation suppressing portion; 350 . . . Power supply electrode (lower support member); 400 . . . Charged particle trapping structure; 410 . . . External potential forming electrode (charged particle trapping structure); 510 . . . MCP-In electrode (upper support member); 520 . . . MCP-Out electrode (output electrode); 620 . . . Insulating ring; and 700 . . . Bleeder circuit board (glass epoxy board).

The invention claimed is:

1. An MCP assembly comprising:

an upper support member including a first opening and comprised of a conductive material;

a lower support member including a second opening and comprised of a conductive material, the lower support member arranged so that the first opening and the second opening overlap along a predetermined axis; and an MCP unit arranged between the upper support member and the lower support member, the MCP unit having an input surface including an input effective area in which one opening ends of plural electron multiplication channels are arranged and abutting the upper support member in a state in which the input effective area is exposed from the first opening, and an output surface including an output effective area in which the other opening ends of the plural electron multiplication channels are arranged;

an output electrode arranged between the MCP unit and the lower support member, the output electrode having a third opening for exposing the output effective area of the output surface and abutting the output surface in a state in which the output effective area is exposed from the third opening; and a flexible sheet electrode arranged between the output electrode and the lower support member, the flexible sheet electrode including an upper surface facing the output electrode, a lower surface at least partially abutting a principal surface of the lower support member facing the upper support member, and a mesh area provided with plural openings each allowing the upper surface and the lower surface to communicate with each other.

2. The MCP assembly according to claim 1, wherein an area of the flexible sheet electrode defined by a plane orthogonal to the predetermined axis is larger than an area of the second opening.

3. The MCP assembly according to claim 1, wherein a width of the flexible sheet electrode along the predetermined axis is smaller than a width of the lower support member.

4. The MCP assembly according to claim 1, further comprising a first insulating member arranged between the output electrode and the lower support member, the first insulating member configured to sandwich at least a part of the flexible sheet electrode together with the lower support member.

5. The MCP assembly according to claim 4, wherein the first insulating member has a first end face abutting the output electrode, a second end face opposing the first end face abutting a part of the flexible sheet electrode, and a first through hole defined by a continuous inner wall surface surrounding an electron transfer space through which electrons from the output surface pass, and the first through hole has a maximum width larger than a maximum width of the output effective area so as to expose an entire output effective area.

6. The MCP assembly according to claim 1, further comprising a second insulating member arranged around the MCP unit and having a shape extending from the upper support member toward the lower support member, the second insulating member including a third end face fixed to the upper support member and a fourth end face fixed to the lower support member.

7. The MCP assembly according to claim 1, further comprising a third insulating member which comprises:

a first fixing unit located on a side opposite to the MCP unit across the upper support member, the first fixing unit abutting the upper support member so as to push the upper support member toward the lower support member;

a second fixing unit located on a side opposite to the MCP unit across the lower support member, the second fixing unit abutting the lower support member so as to push the lower support member toward the upper support member; and a supporting unit having a shape extending from the upper support member toward the lower support member, the supporting unit provided with the first fixing unit on one end and the second fixing unit on the other end.

8. The MCP assembly according to claim 1, wherein the flexible sheet electrode further includes a deformation suppressing portion located between the upper surface and the lower surface and continuously extending from an outer edge of the mesh area in a state of abutting the lower support member.

9. The MCP assembly according to claim 8, wherein the mesh area and the deformation suppressing portion are comprised of the same conductive material and constitute a continuous area having flexibility in a direction coinciding with the predetermined axis, one surface of the mesh area flush with the upper surface is continuous to one surface of the deformation suppressing portion flush with the upper surface, and the other surface of the mesh area flush with the lower surface is continuous to the other surface of the deformation suppressing portion flush with the lower surface.

10. A charged particle detector comprising:

an MCP assembly according to claim 1;

a housing configured to accommodate the MCP assembly; and a charged particle trapping structure for trapping unnecessary charged particles emitted from the MCP assembly via the second opening of the lower support member.

11. The charged particle detector according to claim 10, wherein the charged particle trapping structure includes an external potential forming electrode installed in a position facing the lower support member.

12. The charged particle detector according to claim 11, wherein the external potential forming electrode forms a part of the housing and includes a second through hole that allows an inside of the housing and an outside of the housing to communicate with each other.

13. The charged particle detector according to claim 10, wherein the charged particle trapping structure includes a glass epoxy board on at least a surface of which an electric circuit is provided on which the housing is mounted.

14. A charged particle detector comprising:

the MCP assembly according to claim 1;

a housing configured to accommodate the MCP assembly; and a secondary electron multiplying structure configured to attract secondary electrons multiplied by the MCP assembly and thereafter emitted from the MCP assembly via the second opening of the lower support member.

15. The charged particle detector according to claim 14, wherein the secondary electron multiplying structure includes an external electrode arranged on a side opposite to the MCP unit across the flexible sheet electrode, and configured such that potential is set to be equal to or higher than set potential of the flexible sheet electrode, and a limiting structure for confining reflected electrons emitted from the external electrode in response to incidence of secondary electrons from the MCP unit in a space between the flexible sheet electrode and the external electrode.

16. The charged particle detector according to claim 14, wherein the secondary electron multiplying structure includes a dynode arranged on a side opposite to the MCP unit across the flexible sheet electrode and is configured such that potential is set to be lower than potential of the flexible sheet electrode.

* * * * *